US009719316B2

(12) United States Patent
Lemm

(10) Patent No.: US 9,719,316 B2
(45) Date of Patent: Aug. 1, 2017

(54) RELATIVELY MOVABLE SLIP BODY AND WICKER FOR ENHANCED RELEASE CAPABILITY

(71) Applicant: BAKER HUGHES INCORPORATED, Houston, TX (US)

(72) Inventor: William C. Lemm, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 314 days.

(21) Appl. No.: 14/249,682

(22) Filed: Apr. 10, 2014

(65) Prior Publication Data

US 2015/0292283 A1 Oct. 15, 2015

(51) Int. Cl.
*E21B 23/01* (2006.01)
*E21B 33/129* (2006.01)

(52) U.S. Cl.
CPC ..... *E21B 23/01* (2013.01); *E21B 33/1291* (2013.01)

(58) Field of Classification Search
CPC ..... E21B 23/01; E21B 33/1291
See application file for complete search history.

(56) References Cited

U.S. PATENT DOCUMENTS 2,274,940 A * 3/1942 Stoddard ..... E21B 33/134 166/121
2,598,340 A 5/1952 Baker et al.
2,751,017 A 6/1956 Baker et al.
2,841,224 A 7/1958 Baker et al.
3,019,842 A 2/1962 Nutter
3,097,697 A 7/1963 States
3,279,544 A 10/1966 Tausch et al.
3,526,277 A * 9/1970 Scott ..... E21B 33/1265 166/121
3,831,677 A 8/1974 Mullins
3,993,128 A * 11/1976 Braddick ..... E21B 23/01 166/216
4,311,196 A 1/1982 Beall et al.
5,174,397 A 12/1992 Currington
5,487,427 A 1/1996 Curington
(Continued)

FOREIGN PATENT DOCUMENTS

GB 2323869 A 10/1998

OTHER PUBLICATIONS

Schlumberger Packer Catalog; retrieved from http://www.slb.com/services/completions/completion_products/~/media/Files/completions/catalogs/packers/completions_packer_catalog.ashx; 2011.

*Primary Examiner* — Giovanna C Wright
(74) *Attorney, Agent, or Firm* — Steve Rosenblatt

(57) ABSTRACT

A slip assembly is in two pieces that move relatively to each other to facilitate release. The wicker portion is dovetailed to the base near a center underside location and at the edges. A positive travel stop converts the initial relative movement into tandem movement of the base and the wicker segment after a predetermined relative movement that has resulted in release. Adjacent components prevent relative movement during the radially outward movement for setting the assembly during which there is tandem movement of the base portion and the wicker portion. The two portions can be initially attached with a breakable member that fails during the release movement.

19 Claims, 2 Drawing Sheets

(56) References Cited

U.S. PATENT DOCUMENTS

| | | | | |
|---|---|---|---|---|
| 5,566,762 | A * | 10/1996 | Braddick | E21B 7/061 166/117.6 |
| 5,678,635 | A * | 10/1997 | Dunlap | E21B 23/01 166/123 |
| 5,819,846 | A | 10/1998 | Bolt, Jr. | |
| 6,213,204 | B1 * | 4/2001 | Doane | E21B 23/01 166/134 |
| 6,241,017 | B1 | 6/2001 | Doane et al. | |
| 6,681,858 | B2 | 1/2004 | Streater | |
| 6,827,150 | B2 * | 12/2004 | Luke | E21B 33/1208 166/138 |
| 6,926,089 | B2 | 8/2005 | Goodson et al. | |
| 8,397,802 | B2 | 3/2013 | Lembcke et al. | |
| 8,596,347 | B2 | 12/2013 | Valencia et al. | |
| 2009/0321067 | A1 * | 12/2009 | Kline | E21B 33/134 166/134 |
| 2012/0012306 | A1 | 1/2012 | Treadaway et al. | |

* cited by examiner

RELATIVELY MOVABLE SLIP BODY AND WICKER FOR ENHANCED RELEASE CAPABILITY

FIELD OF THE INVENTION

The field of the invention is slips for anchoring subterranean tools and more particularly a multi-component design that allows relative movement between a slip body and a wicker segment to facilitate release.

BACKGROUND OF THE INVENTION

Slips are typically extended by relative movement with respect to an adjacent cone. As the slip element rides up the cone it is moved radially toward a surrounding tubular. The leading face of each slip has a surface treatment commonly referred to as wickers which can be made of a hard material such as tungsten carbide or polycrystalline diamonds to enhance the bite of the slips into the surrounding tubular. Traditionally, slip wickers are made of carburized (heat-treated) steel. Wickers can also be made of high-yield materials coated with tungsten carbide or carbide inserts can be used in place of wickers by affixing them to a base material. Typically the wickers penetrate the inner wall of the pipe to facilitate the grip. Slips commonly anchor isolation devices such as packers and bridge plugs.

The common issue with slips is to get them to release especially after being set a very long time or after being exposed to extreme loading or operating conditions. Typically, force is applied to the slip to try to force the slip to ride down on the cone for a release of the wickers. Sometimes, especially after a long period of being in a set position and in a debris laden environment it becomes difficult to get the slips to release. Sometimes the slips refuse to fully release and a milling operation that is very expensive is needed to enable removal of the associated device.

Prior designs guide the slips at their edges to make sure they don't cock when being extended and to allow them to tangentially transfer radial loading when part of a continuous slip ring. Typical of some of the one piece slip arrangements are: U.S. Pat. No. 4,311,196; GB 2323869; U.S. Pat. Nos. 6,213,204; 5,487,427; 5,174,397; 3,279,544; and 6,241,017. Existing designs also pose an issue with manufacturing complexity and associated cost, both with the slips and supports, as well as the isolation device itself. These designs still present an issue of difficult release and the present invention presents a design to deal with this issue. The design features a two piece construction with a relatively movable base structure allows pulling the base of the assembly out from under the set wicker portion. The two elements move in tandem for a set. The base portion guides the wicker portion above both in the center and the edge of the wicker portion. These and other features of the present invention will be more readily apparent to those skilled in the art from a review of description of the preferred embodiment and the associated drawings while recognizing that the full scope of the invention is to be determined from the appended claims.

SUMMARY OF THE INVENTION

A slip assembly is in two pieces that move relatively to each other to facilitate release. The wicker portion is dovetailed to the base near a center underside location, at the edges or both. A positive travel stop converts the initial relative movement into tandem movement of the base and the wicker segment after a predetermined relative movement that has resulted in release. Adjacent components prevent relative movement during the radially outward movement for setting the assembly during which there is tandem movement of the base portion and the wicker portion. The two portions can be initially attached with a breakable member that fails during the release movement.

It may also be possible to invert the geometry, such that the wicker and slip body segments are dovetailed at the edge with motion constrained by a tab at the center of the wicker segment and a slot of predetermined length in the center surface of the slip body segment. This alternative geometry would be more complicated, but it is feasible and it may allow additional shoulders between the parts at release.

DETAILED DESCRIPTION OF THE PREFERRED EMBODIMENT

Figure 1:
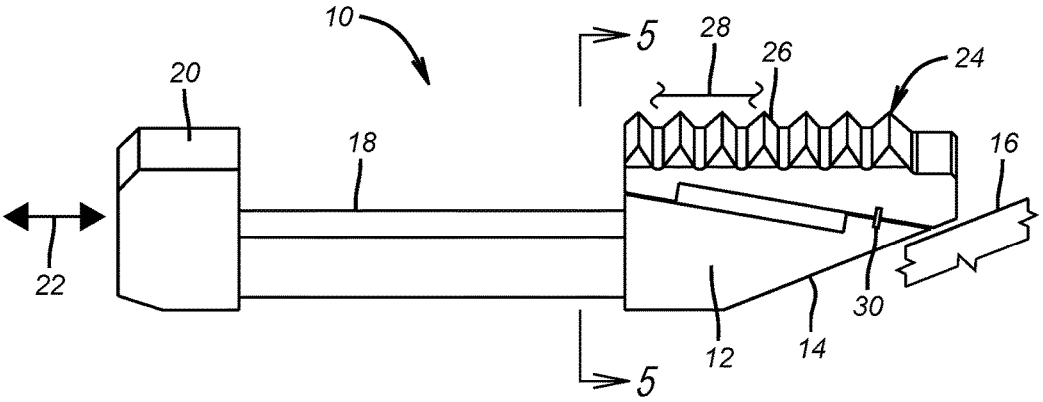
FIG. 1 is a side view of the assembly in the run in position.
Figure 2:
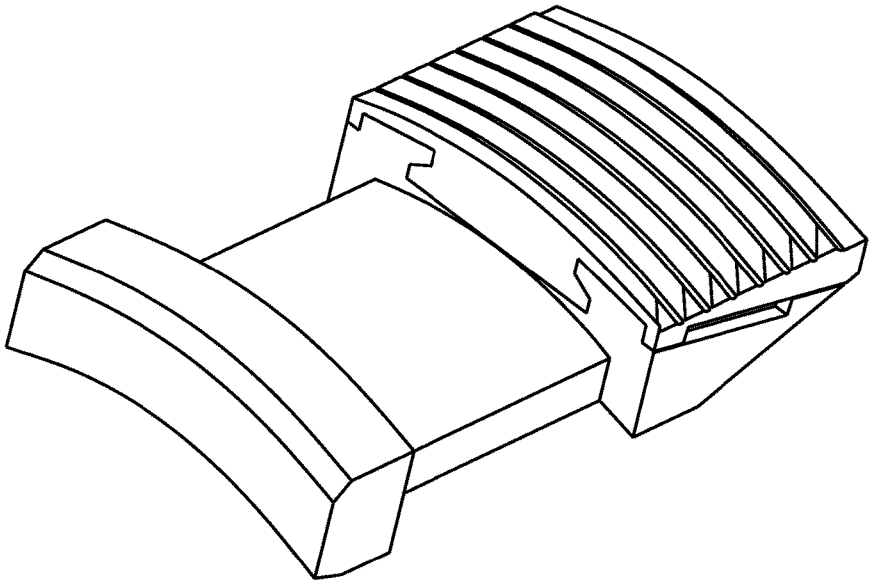
FIG. 2 is a perspective view of the assembly looking at the top of the assembly in the run in position.
Figure 3:
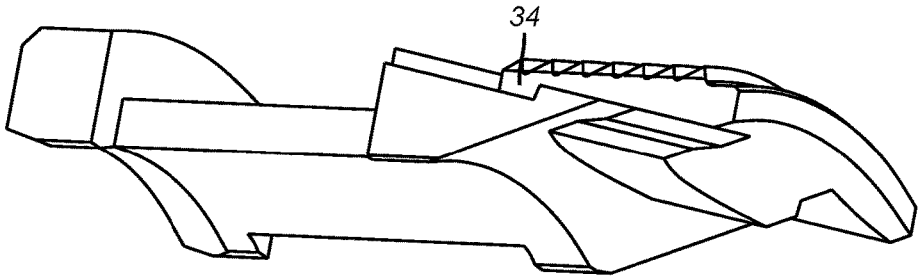
FIG. 3 is a side view of the assembly in the released position.
Figure 4:
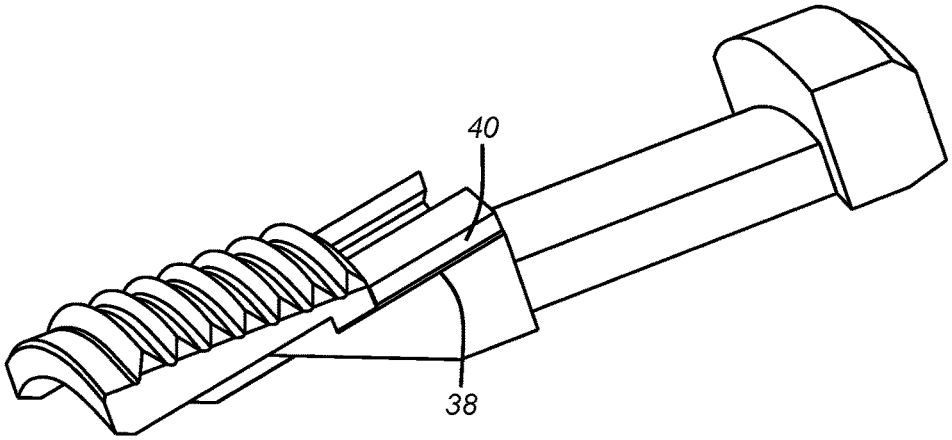
FIG. 4 is a perspective view of the assembly in the released position.
Figure 5:
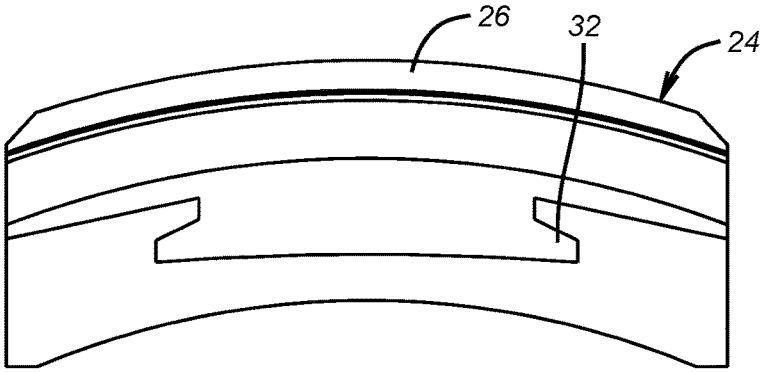
FIG. 5 is the view along lines 5-5 of FIG. 1.
Figure 6:
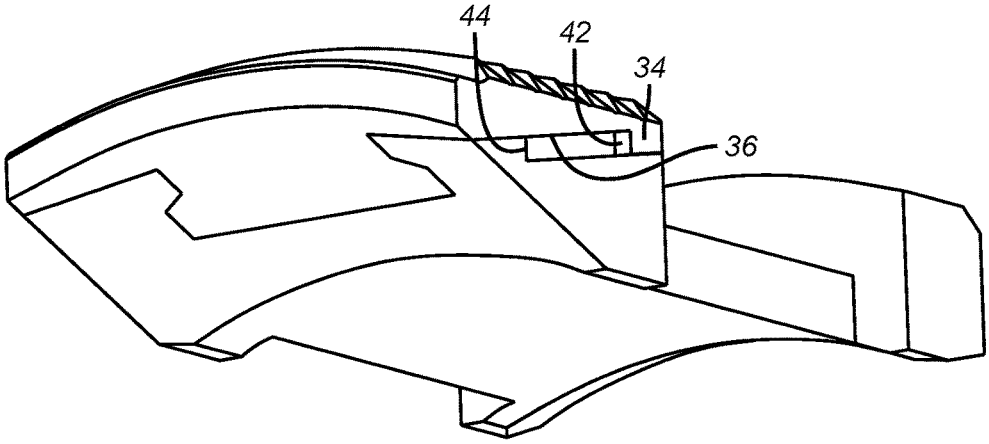
FIG. 6 is a perspective view of the bottom of the assembly in the run in position.

FIG. 1 illustrates a base assembly 10 that has a wicker support segment 12 that has a ramp 14 to ride along a slip cone schematically illustrated as 16. The mandrel of the tool is not shown but such a mandrel supports the cone 16 and has a device to create relative movement for setting and releasing a slip. Segment 12 has a shank 18 that leads to end 20 which is retained by an actuating mechanism that is not shown but is well known in the art. Arrow 22 represents the bidirectional forces that can be applied during the setting and release sequences. For setting a force is applied toward the cone 16. The wicker segment 24 moves in tandem with the base assembly 10 up the cone 16 until the wickers 26 engage and penetrate into the surrounding tubular schematically illustrated as 28. A breakable member 30 can be optionally used to hold the base segment 12 to the wicker segment 24. This device can be a shear pin or other comparable device that releases on a predetermined shear force. During the tandem movement for the setting of the assembly the breakable member 30 will stay intact. At the onset of a pulling force away from cone 16 being applied to end 20 the breakable member 30 will fail. The base segment 10 will then be retracted and its movement will be guided by a dovetail 32 near the center bottom of the wicker segment 24. There is also edge guiding using opposed inwardly facing projecting edge guides 34 that extend from the underside 36 of the wicker segment 24 onto an adjacent guide surface 38. Although this detail is shown in the drawings on one side, it is actually disposed on opposing sides so that the relative movement of segment 12 with respect to the wicker segment 24 that is against the tubular 28 is guided laterally on opposed parallel recessed edge guiding surfaces 40, only one of which is shown in the drawings. Stop surface 42 on guides 34 eventually engages stop surface 44 on opposed sides of segment 12 and after that engagement there is tandem movement of the base segment 10 with the wicker segment 24.

Those skilled in the art will appreciate that the slip assembly has two relatively movable parts allowing a base segment to be pulled out from under a wicker segment. The use of the segment design allows the use of dissimilar materials for the base and wicker segments. It also allows maintaining full area contact for the wicker segment on the surrounding tubular when set. The fixation for tandem movement when setting has support in the center of the underside of the wicker segment and edge support so that during the release sequence the base segment comes back straight using the dovetail and edge guiding. After a predetermined amount of movement of the base relative to the wicker segment there is a travel stop that ends such relative movement so that the wicker segment is forcibly brought down the cone ramp after much of the loading has already been released due to the initial movement of the base segment. As a result much lower release forces are needed than in the known designs and the risk of pulling so hard that the slip shears in two as has happened in the past is removed.

The above description is illustrative of the preferred embodiment and many modifications may be made by those skilled in the art without departing from the invention whose scope is to be determined from the literal and equivalent scope of the claims below:

I claim:

1. A slip assembly for securing a subterranean tool to a surrounding tubular, comprising:

a mandrel supporting a ramp comprising an incline;

a slip assembly for selective movement along said ramp for selective contact and release from engagement with the surrounding tubular, said slip assembly further comprising:

selectively relatively movable and radially stacked base and wicker segments both spanning over while mechanically engaged for moving in tandem in a first direction up said incline to bring said wicker segment into contact with the surrounding tubular and mechanically disengaged to release from the surrounding tubular by initial movement of said base relative to said wicker segments along said ramp.

2. The assembly of claim 1, wherein:

said base and wicker segments move in tandem when moving toward the surrounding tubular.

3. The assembly of claim 2, wherein:

said base segment is moved relatively to said wicker segment when said wicker segment is against the surrounding tubular for release of said wicker segment from the surrounding tubular.

4. The assembly of claim 1, wherein:

said segments are axially relatively movable.

5. The assembly of claim 1, wherein:

said wicker segment is dovetailed to said base segment.

6. The assembly of claim 1, wherein:

said segments allow the use of different materials.

7. The assembly of claim 1, wherein:

said segments are dovetailed together about their respective center axes.

8. The assembly of claim 1, wherein:

said segments can be initially secured to each other with a breakable member.

9. The assembly of claim 8, wherein:

said breakable member remains intact during initial tandem movement toward the surrounding tubular.

10. The assembly of claim 1, wherein:

said base segment is pulled out from under said wicker segment to remove a compressive reaction force on said wicker segment from the surrounding tubular for release of said wicker segment from the surrounding tubular.

11. A slip assembly for securing a subterranean tool to a surrounding tubular, comprising:

a mandrel supporting a ramp;

a slip assembly for selective movement along said ramp for selective contact and release from engagement with the surrounding tubular, said slip assembly further comprising:

selectively relatively movable and stacked base and wicker segments for movement on said ramp to bring said wicker segment into contact with the surrounding tubular and to release from the surrounding tubular;

said relative movement brings stop surfaces on said segments into contact for subsequent tandem movement.

12. A slip assembly for securing a subterranean tool to a surrounding tubular, comprising:

a mandrel supporting a ramp;

a slip assembly for selective movement along said ramp for selective contact and release from engagement with the surrounding tubular, said slip assembly further comprising:

selectively movable and stacked base and wicker segments for movement on said ramp in the same first direction to bring said wicker segment into contact with the surrounding tubular and to release from the surrounding tubular by relative movement in a second direction opposite said first direction;

said wicker segment further comprises edge projections to maintain alignment between said segments during relative movement between them.

13. A slip assembly for securing a subterranean tool to a surrounding tubular, comprising:

a mandrel supporting a ramp;

a slip assembly for selective movement along said ramp for selective contact and release from engagement with the surrounding tubular, said slip assembly further comprising:

selectively movable and stacked base and wicker segments for movement on said ramp in the same first direction to bring said wicker segment into contact with the surrounding tubular and to release from the surrounding tubular by relative movement in a second direction opposite said first direction;

said base segment comprises opposed edge recesses in which ride opposed projections on said wicker segment for guidance of relative movement therebetween.

14. A slip assembly for securing a subterranean tool to a surrounding tubular, comprising:

a mandrel supporting a ramp;

a slip assembly for selective movement along said ramp for selective contact and release from engagement with the surrounding tubular, said slip assembly further comprising:

selectively movable and stacked base and wicker segments for movement on said ramp in the same first direction to bring said wicker segment into contact with the surrounding tubular and to release from the surrounding tubular by relative movement in a second direction opposite said first direction;

said base segment has opposed guiding surface disposed at an angle to an axis of said mandrel.

15. A slip assembly for securing a subterranean tool to a surrounding tubular, comprising:

a mandrel supporting a ramp;

a slip assembly for selective movement along said ramp for selective contact and release from engagement with the surrounding tubular, said slip assembly further comprising:

selectively relatively movable and stacked base and wicker segments for movement on said ramp to bring said wicker segment into contact with the surrounding tubular and to release from the surrounding tubular;

said base and wicker segments move in tandem when moving toward the surrounding tubular;

said base segment is moved relatively to said wicker segment when said wicker segment is against the surrounding tubular for release of said wicker segment from the surrounding tubular;

said relative movement brings stop surfaces on said segments into contact for subsequent tandem movement.

16. The assembly of claim 15, wherein:

said segments are axially relatively movable.

17. The assembly of claim 16, wherein:

said wicker segment is dovetailed to said base segment.

18. The assembly of claim 17, wherein:

said wicker segment further comprises edge projections to maintain alignment between said segments during relative movement between them.

19. The assembly of claim 18, wherein:

said base segment is pulled out from under said wicker segment to remove a compressive reaction force on said wicker segment from the surrounding tubular for release of said wicker segment from the surrounding tubular.

* * * * *